US007531962B2

(12) United States Patent
Kunii et al.

(10) Patent No.: US 7,531,962 B2
(45) Date of Patent: May 12, 2009

(54) FLAT PANEL DISPLAY FORMED BY TETRAGONAL FIRST AND SECOND SUBSTRATES

(75) Inventors: Yasuhiko Kunii, Kawasaki (JP); Hiroyuki Nakahara, Kawasaki (JP); Tomohiko Murase, Kawasaki (JP); Fumihiro Namiki, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 0 days.

(21) Appl. No.: 10/928,102

(22) Filed: Aug. 30, 2004

(65) Prior Publication Data

US 2005/0110411 A1 May 26, 2005

(30) Foreign Application Priority Data

Nov. 26, 2003 (JP) ..... 2003-396145

(51) Int. Cl.
*H01J 17/49* (2006.01)

(52) U.S. Cl. ..... 313/582; 313/587; 445/24

(58) Field of Classification Search ..... 313/582–587; 445/24

See application file for complete search history.

(56) References Cited

U.S. PATENT DOCUMENTS

| | | | | |
|---|---|---|---|---|
| 5,578,903 | A | 11/1996 | Pepi | |
| 5,635,795 | A | 6/1997 | Itoh et al. | |
| 5,703,665 | A * | 12/1997 | Muramatsu et al. | 349/60 |
| 5,789,858 | A | 8/1998 | Itoh et al. | |
| 5,982,470 | A * | 11/1999 | Nakahara et al. | 349/153 |
| 6,400,080 | B1 * | 6/2002 | Tanaka | 313/582 |
| 6,407,509 | B1 * | 6/2002 | Ikeda et al. | 315/169.4 |
| 6,420,831 | B2 * | 7/2002 | Awaji et al. | 313/586 |
| 6,961,111 | B1 * | 11/2005 | Kuramasu | 349/152 |
| 7,273,403 | B2 | 9/2007 | Yokota et al. | |
| 2002/0033669 | A1 * | 3/2002 | Kanazawa et al. | 313/582 |
| 2002/0125815 | A1 * | 9/2002 | Wakita | 313/491 |

FOREIGN PATENT DOCUMENTS

| | | |
|---|---|---|
| JP | 58-139174 | 8/1983 |
| JP | 2-244540 | 9/1990 |
| JP | 4-56039 | 2/1992 |

(Continued)

OTHER PUBLICATIONS

European Search Report, mailed Feb. 15, 2008 and issued in corresponding European Patent Application No. 04255248.9-2208.

(Continued)

*Primary Examiner*—Toan Ton
*Assistant Examiner*—Hana A Sanei
(74) *Attorney, Agent, or Firm*—Staas & Halsey LLP

(57) ABSTRACT

To maximize the efficiency of utilization of mother substrates used as material for the substrates in the flat display panel to form a display screen, the flat display panel includes a display screen formed by tetragonal first and second substrates. Four sides or opposite two sides forming a tetragonal peripheral edge of the first substrate are rendered to be substantially equal to those of the second substrate, and the first and second substrate are sandwiched together with one of the first and second substrates protruding in part outwardly from the peripheral edge of the other of the first and second substrates.

10 Claims, 6 Drawing Sheets

FOREIGN PATENT DOCUMENTS

| | | |
|---|---|---|
| JP | 7-8944 | 2/1995 |
| JP | 8-255568 | 10/1996 |
| JP | 2002-134037 | 5/2002 |
| JP | 2003-197103 | 7/2003 |

OTHER PUBLICATIONS

Chinese Patent Office Action, mailed Dec. 21, 2007 and issued in corresponding Chinese patent Application No. 2004100588912.

* cited by examiner

FLAT PANEL DISPLAY FORMED BY TETRAGONAL FIRST AND SECOND SUBSTRATES

BACKGROUND OF THE INVENTION

1. Field of the Invention

The present invention generally relates to a flat panel display such as, for example, a plasma display panel and, more particularly, to the flat panel display of a structure including a pair of substrates larger than a screen, in which one of the substrates has a peripheral edge partly protruding outwardly from that of the other of the substrates.

2. Description of the Prior Art

With keen interests centered on the environmental protection, various attempts have hitherto been made and are currently made in the field of industrial production of various products to minimize emission of industrial wastes. This is not an exception to the mass production of flat panel displays (FPDs) such as, for example, plasma display panels, liquid crystal panels, field emission display panels, organic electroluminescence panels and others. As is well understood by those skilled in the art, maximized utilization of materials contributes, to a large extent, to reduction in manufacturing cost and also to the environmental protection.

The plasma display panel is known, which emits image-wise light as a result of gas discharges developed in between a pair of substrates that are sandwiched together. In the plasma display panel of a type having a screen capable of achieving a matrix display, activation of a multiplicity of cells forming the display screen is controlled by column electrodes disposed on one of the substrates and row electrodes disposed on the other of the substrates. The column and row electrodes have respective ends drawn outwardly from the screen for electric connection with a matrix drive circuit as is well known to those skilled in the art.

By way of example, Japanese unexamined patent publication No. 8-255568, for example, discloses the use of flexible wiring boards for electrically connecting between the column and row electrodes and the matrix drive circuit, respectively. According to this published application, in order for the flexible wiring boards to be electrically connected with the column and row electrodes, respectively, by means of a heat press technique, the first and second substrates are sandwiched together so that respective ends of the column electrodes in the first substrate may protrude outwardly from the periphery of the second substrate while respective ends of the row electrodes in the second substrate may similarly protrude outwardly from the periphery of the first substrate.

Specifically, referring to FIG. 1, there is shown, in a schematic top plan view, the structure of the conventional plasma display panel. This conventional plasma display panel 1*z* shown therein includes first and second substrates 11*z* and 21*z* of a generally or substantially rectangular configuration each having a size larger than the display screen 51*z*. More particularly, while each of the first and second substrates 11*z* and 21*z* has a pair of short side edges opposite to each other and a pair of long side edges opposite to each other, the short side edges of one of the first and second substrates, for example, the second substrate 21*z* have a length c longer by about 1 cm than the length a of those of the first substrate 11*z* whereas the long side edges of the first substrate 11*z* have a length b longer by about 1 cm than the length d of those of the second substrate 21*z*.

The first and second substrates 11*z* and 21*z* of different sizes as discussed above are positioned one above the other with their geometric centers aligned with each other. In this condition, the short side edges of the first substrate 11*z* protrude longitudinally outwardly, each a distance of about 5 mm, from those of the second substrate 21*z* in a horizontal direction, whereas the long side edges of the second substrate 21*z* protrude longitudinally outwardly, each a distance of about 5 mm, from those of the first substrate 11*z* in a direction orthogonal to the horizontal direction, that is, in a vertical direction.

It has, however, been found that as shown in and discussed with reference to FIGS. 2A and 2B, manufacture of the plasma display panel of a type utilizing the substrates of different sizes such as used in the conventional plasma display panel discussed above tends to yield a substantial amount of wastes resulting from sectioning, trimming, or otherwise cutting of the material for each of the first and second substrates.

More specifically, FIG. 2A illustrates two mother substrates $\mathbf{100}_1$ and $\mathbf{100}_2$ of the same size, which, when trimmed as will be discussed subsequently, eventually form the first and second substrates 11*z* and 21*z* of the different sizes. Considering that the first and second mother substrates $\mathbf{100}_1$ and $\mathbf{100}_2$ are of the same size, i.e., of a size that does not result in any lateral protrusion of any part of the mother substrates $\mathbf{100}_1$ and $\mathbf{100}_2$, trimming of the first mother substrate $\mathbf{100}_1$ along one short side edge portion thereof to provide the first substrate 11*z* results in an elongated scrap 91 and, similarly, trimming of the second mother substrate $\mathbf{100}_2$ along one long side edge portion thereof to provide the second substrate 21*z* results in an elongated scrap 92. The resultant scraps 91 and 92 are, of course, a waste that is to be disposed of without being reused nor recycled and are no longer utilized in part or in entirety as a part of the plasma display panel.

Similarly, similar scraps 93 and 94 may result in even where a plurality of, for example, two, first substrates $\mathbf{11}z_1$ and $\mathbf{11}z_2$ and correspondingly two second substrates $\mathbf{21}z_1$ and $\mathbf{21}z_2$ are to be prepared from the mother substrates $\mathbf{200}_1$ and $\mathbf{200}_2$, respectively, as shown in FIG. 2B.

To minimize waste of the material for the substrates, the use may be contemplated of relatively large mother substrates each having a size that is an integer multiplication of the size of the respective substrate $\mathbf{11}z_1$ or $\mathbf{21}z_1$. However, the use of such large mother substrates requires complicated and costly maintenance and storage of two kinds of mother substrates of different sizes. As such, diversification of the materials of different sizes is undesirable because the cost of manufacture of the plasma display panels would eventually result in.

In view of the foregoing, the present invention has for its object to maximize the efficiency of utilization of mother substrates that are material for the substrates used in the flat display panel to form a screen.

SUMMARY OF THE INVENTION

In order to accomplish the foregoing object of the present invention, the flat display panel in accordance with one aspect of the present invention includes tetragonal first and second substrates sandwiched together with one of the first and second substrates protruding in part outwardly from the peripheral edge of the other of the first and second substrates. The first and second substrates when in a sandwiched condition defines a display screen. Each of the first and second substrates has a tetragonal peripheral edge, and two sides of the tetragonal peripheral edge of the first substrate, which are opposite to each other, are of a length substantially equal to that of each of two sides of the tetragonal peripheral edge of the second substrate, which are opposite to each other. Also, three sides of the peripheral edge of the first substrate, including said two opposite sides of the peripheral edge of the first substrate, are positioned outwardly from the peripheral edge of the second substrate over an entire perimeter thereof.

According to the present invention, the use of the glass substrates having their respective portions of the peripheral edges that are substantially equal in size is effective to maximize the utilization of materials for those glass substrates. Specifically during the preparation of the substrates to be used in the manufacture of the flat display panel, in which the first and second substrates are cut from two mother substrates of the same size, respectively, at least one of the mother substrates does not yield any scrap.

Respective features as set forth in the appended claims are effective to maximize the utilization of the mother substrate and, hence, the cost which would be incurred in manufacturing the flat display panel can advantageously reduced.

In summary, the present invention is featured in that a pair of substrates used to form a screen are commonly shared in size with each other. The screen of a flat panel display to which the present invention is applied, includes a first rectangular substrate and a second rectangular substrate having four or two sides equal in size to those of the first rectangular substrate. The first and second substrates are overlapped one above the other with one of them partially protruding outwardly from the perimeter of the other of them. Where the first and second substrates are of the same size, two of the four sides of the first substrate, which adjoin to each other, are positioned outside the perimeter of the second substrate over their entire length, while two of the four sides of the second substrate, which similarly adjoin to each other, are positioned inside the perimeter of the first substrate over their entire length. Where only two sides of one of the first and second substrates are equal in size to two sides of the other of the first and second substrates, three of the four sides of the first substrate, which includes two sides opposite to each other, are positioned outside the perimeter of the second substrate over their entire length.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF THE PREFERRED EMBODIMENTS

In the practice of the present invention, mother substrates having a minimum necessary size or surface area are used as materials for substrates that are employed during the manufacture of a plasma display panel (PDP), a sort of flat panel displays. As a matter of fact, the size and the contour of each of the substrates used in the plasma display depend on the specification of the display screen. Considering that the typical aspect ratio of the high-definition TV display screen currently broadcasted in Japan and some other countries is defined 16:9, rectangular substrates are suitably and conveniently employed in the manufacture of the plasma display panel. However, where the display screen is of a nearly square shape, square substrates are suitably and conveniently employed.

Figure 1:
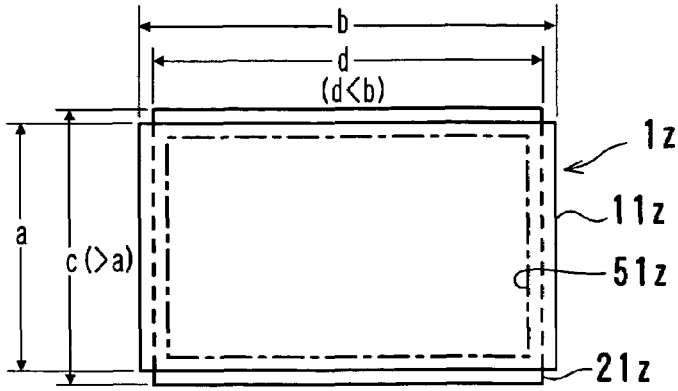
FIG. 1 PRIOR ART
FIG. 1 is a schematic top plan view of the conventional plasma display panel.
Figure 2A:
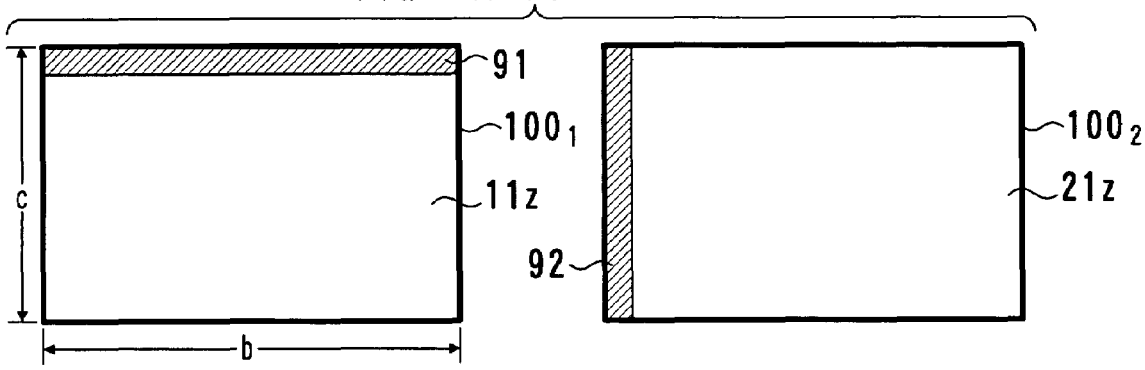
FIG. 2A PRIOR ART
FIGS. 2A and 2B are schematic diagrams showing how panel substrates are prepared from different mother substrates of different sizes, respectively, during the manufacture of the conventional plasma display panel.
Figure 2B:
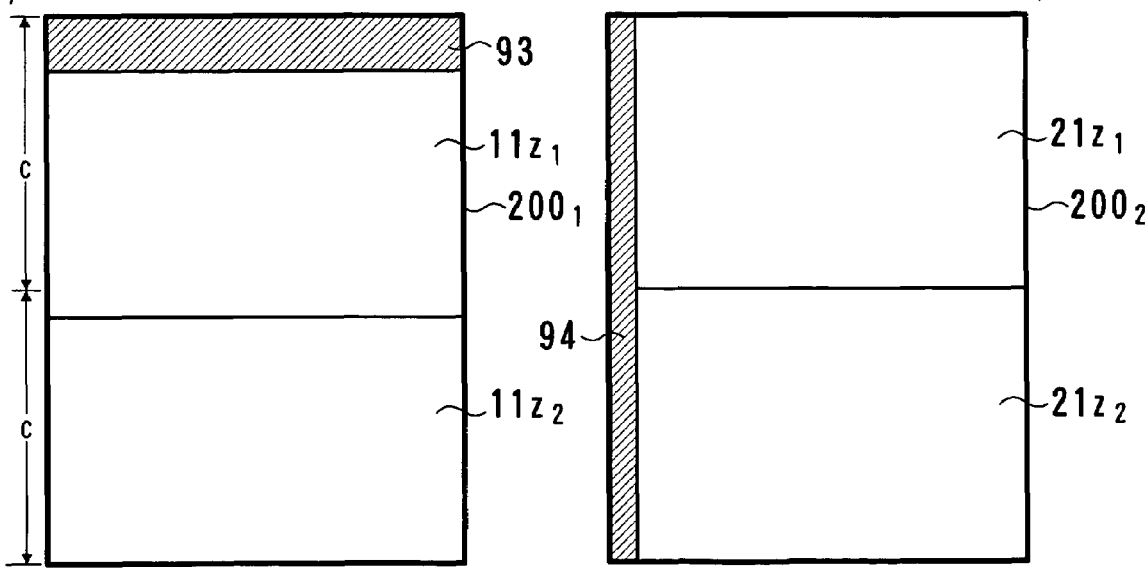
FIG. 2B PRIOR ART
Figure 3:
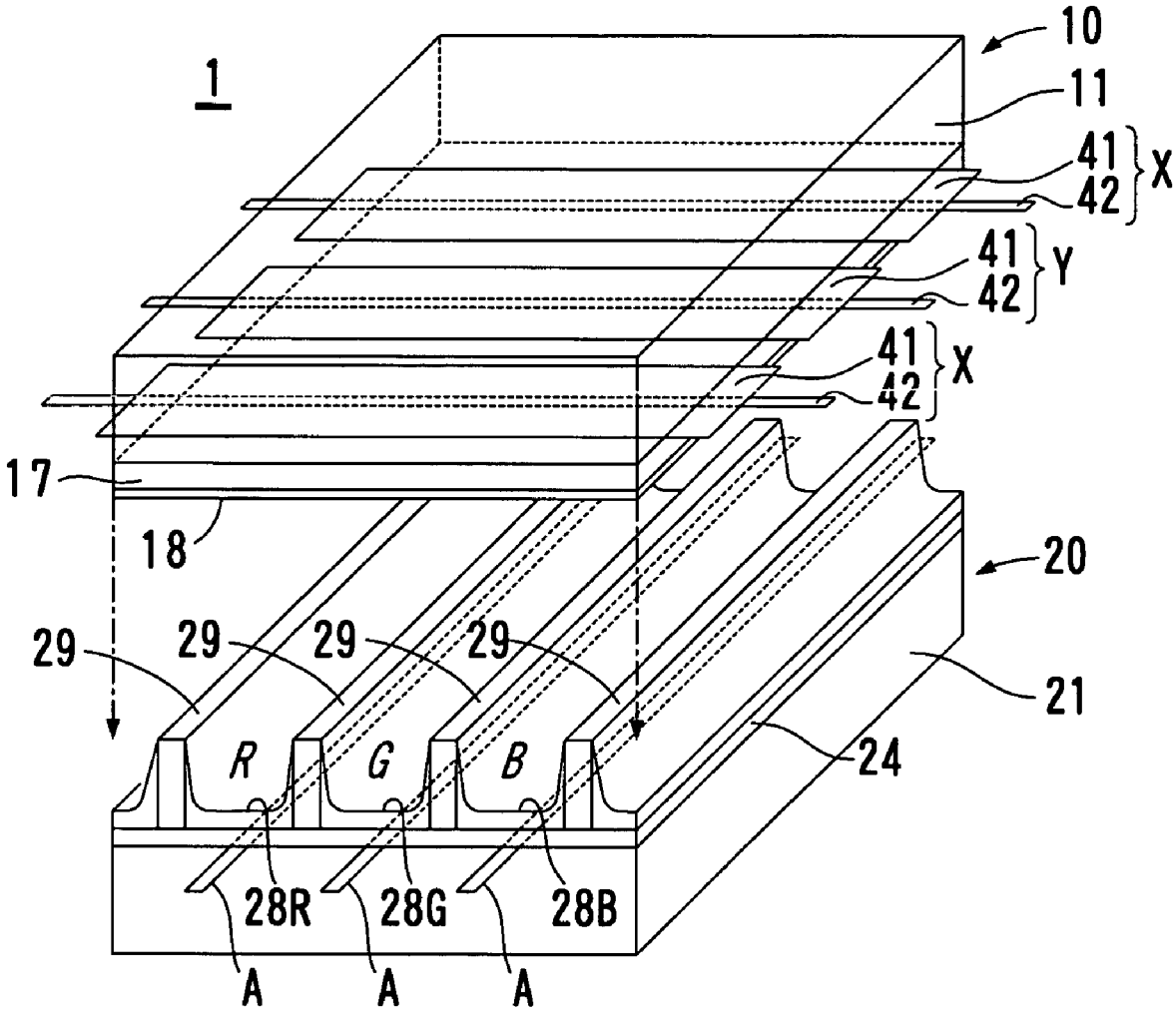
FIG. 3 is a schematic exploded view showing the cell structure used in a plasma display panel according to the present invention.

FIG. 3 illustrates the cell structure of the plasma display panel, to which the present invention generally pertains. In FIG. 3, first (front) and second (rear) substrate structures 10 and 20 employed in the plasma display panel 1 are shown as separated from each other to facilitate a better understanding the interior structural details found between the first and second glass substrate structures 10 and 20. It is to be noted that each of the first and second glass substrate structures is comprised of a substrate of a size larger than that of the display screen and at least one cell defining element.

The plasma display panel 1 is a three-electrode surface discharge AC type PDP. The front substrate structure 10 includes a first glass substrate 11, a plurality of first display electrodes X, second display electrodes Y, a dielectric layer 17 and a protective layer 18. The first and second display electrodes X and Y form respective surface discharge electrode pairs and are each made up of a transparent electroconductive film 41 for defining a surface discharge gap and a metallic film 42 which is a bus conductor for reducing the electric resistance. The transparent electroconductive film 41 shown therein is in the form of a thin electroconductive strip of a predetermined width.

On the other hand, the rear substrate structure 20 includes a second glass substrate 21, a plurality of address electrodes A, a dielectric layer 24, a plurality of partition walls 29 and phosphor films 28R, 28G and 28B. Each of the partition walls 29 shown therein is in the form of a straight ridge and is positioned between the neighboring address electrodes. Those partition walls 29 divide the gas-filled space, defined between the first and second glass substrates 11 and 21, into a plurality of cells one for each of the columns of the matrix display.

It is to be noted that alphabetical characters "R", "G" and "B" each affixed to the reference numeral "28" referred to above and shown in FIG. 3 stands for red, green and blue, respectively, of light emitted from the associated phosphor films.

When a picture is to be displayed, one of the first and second display electrodes, for example, the second display electrodes Y are used as a scanning electrode for selection of one of the rows and addressing to form a wall charge on a surface of a portion of each dielectric layer 17 aligned with a cell to be energized can be performed by causing an addressing discharge to develop between the scanning electrode and the address electrode. After this addressing, a train of sustaining pulses of alternating polarities are applied to the display electrode pairs, i.e., the first and second display electrodes so that each time the sustaining pulse is applied, a display discharge in the form of a surface discharge develops between respective portions of the first and second display electrodes aligned with the cell to be energized so as to propagate along a surface of the substrates. The discharge gas filled within the gas-filled space then emits ultraviolet rays of light, which in turn excite the fluorescent films 28R, 28G and 28B to emit light of respective colors.

In the practice of the present invention, where the first or front glass substrate 11 and the second or rear glass substrate 21 have respective electrodes deposited thereon, the cell structure may not be always limited to that shown and described above. It is to be noted that each of the partition walls, which has been shown and described as extending straight, may be in the form of a tortuous ridge, provided that the partition walls as a whole can divide the display screen area into a mesh of cells. It is also to be noted that the particular shape and the particular arrangement of the electrodes employed and/or the presence or absence of the dielectric layers may be suitably and conveniently chosen as desired.

Referring now to FIGS. 4A to 4D pertaining to the first preferred embodiment of the present invention, a plasma display panel 1 shown therein has a display screen area 51 formed by a sandwiched structure of first and second glass substrates 11 and 21 of a generally or substantially rectangular configuration. The first and second glass substrates 11 and 21 are, as is well known to those skilled in the art, positioned generally one above the other and sealed together by means of a peripheral sealing member 33. It is, however, to be noted that in the practice of the present invention, with the glass substrates positioned one above the other in a fashion immovable relative to each other as will become clear from the subsequent description, one of those glass substrates has at least a portion of the entire peripheral edge thereof protruding outwardly from that of the other of those glass substrates.

By the reason which will become clear from the subsequent description, the sealing member 33 utilized to connect the first and second glass substrates 11 and 21 together encompasses only respective areas of the first and second glass substrates 11 and 21, which overlap substantially exactly one above the other to define therebetween the gas-filled space 30 filled with a discharge gas. This sealing member 33 is in the form of a generally rectangular frame-like configuration having four side edges and also has a width of about 5 mm, with the four side edges of the sealing member 33 spaced a distance of about 20 mm outwardly from adjacent peripheral side edges of the display screen area 51, regardless of the size of the display screen area 51.

Although exaggerated in FIGS. 4A to 4D, the amount of protrusion of at least a portion of the entire peripheral edge of one of the glass substrates, which protrudes outwardly from that of the other of the glass substrates, is in practice within the range of about 5 to 8 mm. In other words, each of the first and second glass substrates 11 and 21 is of a size larger than the display screen area 51 by a quantity equal to the sum of the width of the sealing member 33, the distance between the sealing member 33 and the periphery of the display screen area 51 and the amount of protrusion of at least that portion of the entire peripheral edge of one of the glass substrates relative to that of the other of the glass substrates. By way of example, in the case of the display screen area having the aspect ratio of 16:9 and having a 42 inch diagonal size, each of the first and second glass substrates 11 and 21 is larger than the area of 970×570 mm.

According to the embodiment now under discussion with particular reference to FIGS. 4A to 4D, the first glass substrate 11 has a peripheral edge made up of a pair of opposite short side edge portions 111 and 113 and a pair of opposite long side edge portions 112 and 114 and, similarly, the second glass substrate 21 has a peripheral edge made up of a pair of opposite short side edge portions 211 and 213 and a pair of opposite long side edge portions 212 and 214. Of the four side edge portions of the first glass substrate 11, two side edge portions that are opposite to each other, for example, the short side edge portions 111 and 113 have a length al which is substantially equal to the length cl of each of two of the four side edge portions of the second glass substrate 21 that are opposite to each other, that is, the short side edge portions 211 and 213 of the second glass substrate 21. Also, the long side edge portions 112 and 114 of the first glass substrate 11 that are opposite to each other have a length b1 which is greater than the length d1 of each of the long side edge portions 212 and 214 of the second glass substrate 21.

Figure 4A:
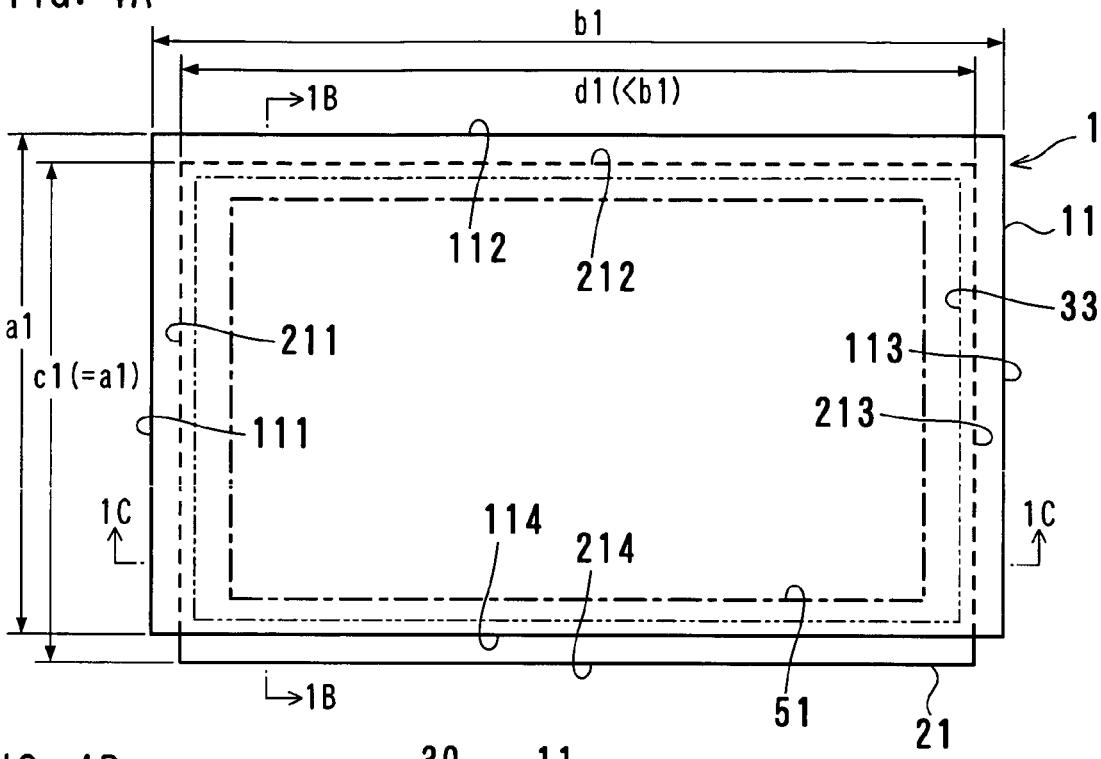
FIG. 4A is a top plan view of a first preferred embodiment of the plasma display panel according to the present invention.
Figure 4B:
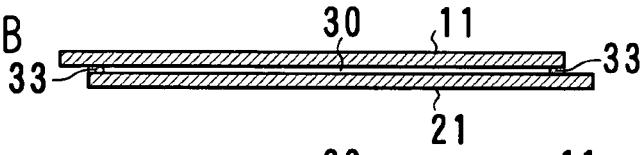
FIGS. 4B and 4C are cross-sectional views taken along the lines 1B-1B and 1C-1C in FIG. 4A, respectively.
Figure 4C:
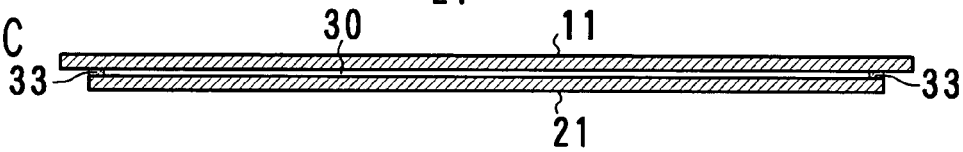

Accordingly, when the first and second glass substrates 11 and 21 are positioned one above the other during the manufacture of the plasma display panel 1 of the present invention, the geometric center of the first glass substrate 11 is displaced relative to that of the second glass substrate 21 in a direction parallel to any one of the short side edges. In this displaced condition, since the opposite long side edge portions 112 and 114 of the first glass substrate 11 are longer than any one of the opposite long side edge portions 212 and 214 of the second glass substrate 21, it is clear that the short side edge portions 111 and 113 and one of the long side edges portions, that is, the long side edge portion 112 of the first glass substrate 11 protrude outwardly from the adjacent side edges 211, 213 and 212 of the second glass substrate 21 while the other long side edge portion 214 of the second glass substrate 21 protrude laterally outwardly from the remaining long side edge portion 114 of the first glass substrate 11 as best shown in FIG. 4A.

It is to be noted that the length of any one of the four side edge portions of the first glass substrate 11 and the length of one of the four side edge portions of the second glass substrate 21, which is positioned adjacent to and extends generally or substantially parallel to such any one of the four side edge portions of the first glass substrate may vary relative to each other depending on the precision of grinding when the first and second glass substrates 11 and 21 are prepared from respective mother substrates. Accordingly, if the difference between those lengths is about 1 mm or less, such difference can be deemed within the design tolerance and should, therefore, be construed as encompassed within the term "substantially" used in connection with the sameness between the length al of each short side edge portions 111 and 113 and the length cl of each short side edge portion 211 and 213 as described above.

The above statement on the difference in length equally applies to any other embodiment of the present invention, in which a similar difference is present between the length of any one of the four side edge portions of the first glass substrate and the length of one of the four side edge portions of the second glass substrate, which is positioned adjacent to and extends generally or substantially parallel to such any one of the four side edge portions of the first glass substrate.

As described above the long side edge portion 214 of the second glass substrate 21 is positioned laterally outside the adjacent long side edge portion 114 of the first glass substrate 11 and the other side edge portions 211, 212 and 213 of the second glass substrate 21 are set back inwardly of the adjacent side edge portions 111, 112 and 113 of the first substrate 11, allowing such adjacent side edge portions 111, 112 and 113 of the first substrate 11 to protrude outwardly relative to the second substrate 21. Accordingly, in terms of grinding efficiency, the entire peripheral edge of both of the first and second glass substrates 11 and 21 need not be ground and grinding to be effected to the peripheral edge of the sandwich structure of the first and second substrates 11 and 21 may be comparable to grinding of the peripheral edge of a single substrate, thus resulting in increase of the grinding workability.

Figure 4D:
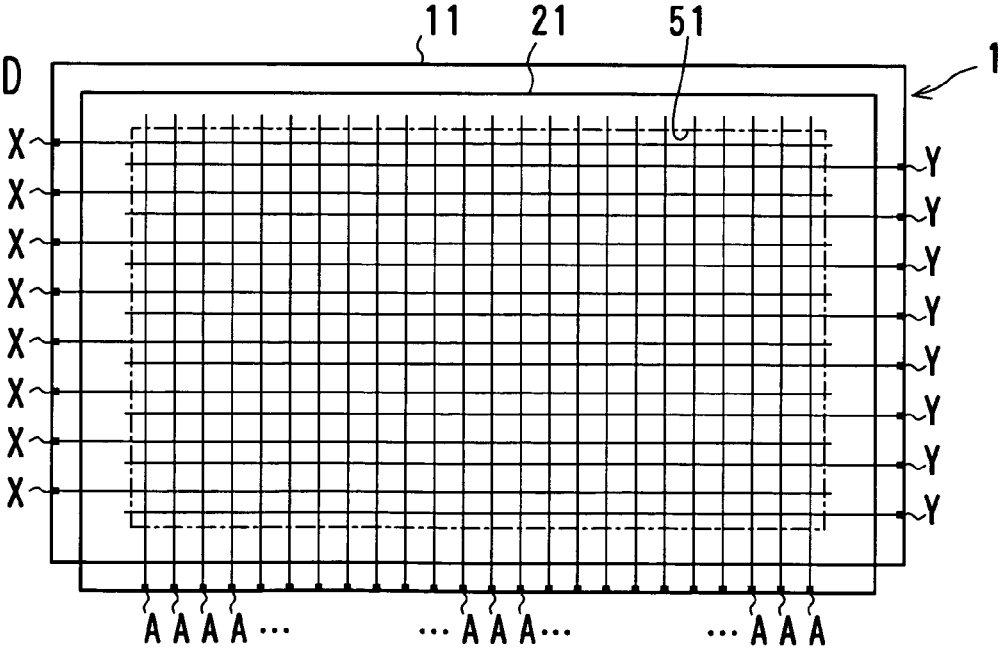
FIG. 4D is a schematic top plan view of the plasma display panel according to the present invention, showing a matrix of column and row electrodes employed therein.

Referring particularly to FIG. 4D, in the plasma display panel 1, the first and second display electrodes X and Y deposited on an inner surface of the first glass substrate 11 facing the second glass substrate 21 are so arranged and so laid as to alternate one after the other. In this electrode arrangement, one of opposite ends, for example, a first end, of each of the first display electrodes X emerges outwardly from the display screen area 51 and, hence, the second glass substrate 21 and is positioned in the short side edge portion 111 thereof, whereas one of opposite ends of each of the second display electrodes Y remote from the first ends of the first display electrode X, that is, a second end of each second display electrode Y, emerges similarly outwardly from the display screen area 51 and, hence, the second glass substrate 21 and is positioned in the short side edge portion 113 of thereof. Since as hereinbefore described the short side edge portions 111 and 113 of the first glass substrate 11 protrudes laterally outwardly from the second glass substrate 21 in respective directions away from each other, it is quite clear that the first ends of the first display electrodes X and the second ends of the second display electrodes Y can be positioned in the short side edge portions of the first glass electrode 11, respectively.

The use of the electrode arrangement shown in and described with reference to FIG. 4D is particularly advantageous in that the extent to which the electrodes are exposed to the outside of the region encompassed by the sealing member 33 can be minimized, resulting in reduction in work load which would otherwise be imposed in applying electrically insulating and water proofing resins to the exposed portions of the electrodes.

Also, the manner in which the first and second ends of the first and second display electrodes X and Y, respectively, are drawn outwardly through the display screen area 51 to the outside is such as to distribute the first ends of the first display electrodes X and the second ends of the second display electrodes Y to occupy the opposite short side edge portions 111 and 113 of the first glass substrate, respectively, and accordingly, the distributed disposition of those exposed ends of the first and second display electrodes X and Y is also advantageous in that the wiring employed in a drive circuit can be simplified as the first and second exposed ends of the first and second display electrodes X and Y, respectively, do not mix up in one site.

On the other hand, the address electrodes A disposed on an inner surface of the second glass substrate 21 facing the first glass substrate 11 extend perpendicular to and across the first and second display electrodes X and Y, each having one of its opposite ends emerging outwardly from the display screen area 51 and positioned only on the long side edge portion 214 of the second glass substrate 21.

In the manufacture of the flat panel displays, particularly that of the plasma display panel 1, the use of the glass substrates having their respective short side edges portions of an equal size is effective to maximize the utilization of materials for those glass substrates. Specifically, with two mother substrates of the same size in hand, and if those mother substrates are trimmed to provide the first and second glass substrates, respectively, preparation of the first and second glass substrates of the different sizes as discussed hereinbefore results in that at least one of the first and second glass substrates will not yield any scrap while the other of the first and second glass substrates can be used in its entirety.

Figure 5A:
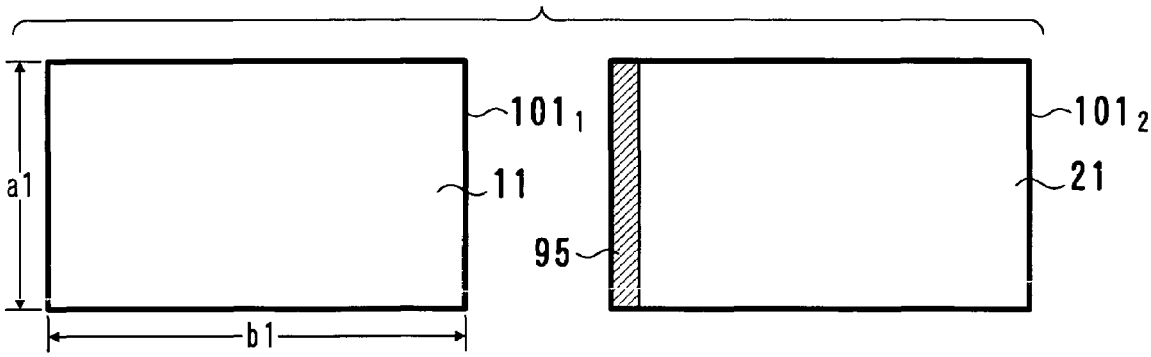
FIG. 5A is a schematic diagram showing the manner in which first and second glass substrates of different sizes employed in the practice of the present invention are prepared from corresponding mother substrates.

Referring particularly to FIG. 5A, there is shown the first and second glass substrates 11 and 21 prepared from the two mother substrates $\mathbf{101}_1$ and $\mathbf{101}_2$ of the same size. While each of the mother substrates $\mathbf{101}_1$ and $\mathbf{101}_2$ is of the same size as the first glass substrate 11, but is of a size sufficient to encompass the second glass substrate 21 completely, i.e., larger than the second glass substrate 21. Accordingly, even though a scrap 95 is yielded when the second glass substrate 21 is prepared from the first mother substrate $\mathbf{101}_2$, no scrap is yielded with the first mother substrate $\mathbf{101}_1$ since the latter is in its entirety used as the first glass substrate 11.

Figure 5B:
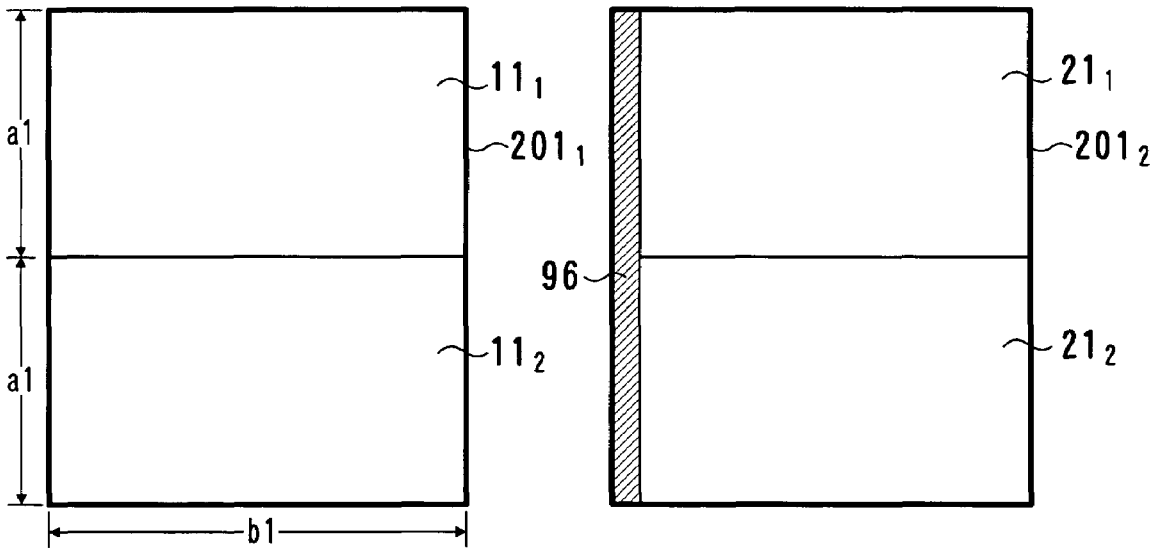
FIG. 5B is a schematic diagram showing a modified manner in which first and second glass substrates of different sizes employed in the practice of the present invention are prepared from corresponding mother substrates.

FIG. 5B illustrates the different manner in which each of a plurality of first glass substrates $\mathbf{11}_1$ and $\mathbf{11}_2$ and a plurality of second glass substrates $\mathbf{21}_1$ and $\mathbf{21}_2$ are prepared from two single mother substrates $\mathbf{201}_1$ and $\mathbf{201}_2$ of the same size, respectively. So far shown therein, each of the single mother substrates $\mathbf{201}_1$ and $\mathbf{201}_2$ is of a size exactly twice the size of the glass substrate $\mathbf{11}_1$ and of a size sufficient to encompass both of the corresponding glass substrate $\mathbf{21}_1$ and $\mathbf{21}_2$ completely. Accordingly, even though a scrap 96 is yielded when the two second glass substrates $\mathbf{21}_1$ and $\mathbf{21}_2$ are prepared from the second single mother substrate $\mathbf{201}_2$, no scrap is yielded with the first single mother substrate $\mathbf{201}_1$ since the latter is in its entirety used as the first glass substrates $\mathbf{11}_1$ and $\mathbf{11}_2$. In other words, the two first glass substrates $\mathbf{11}_1$ and $\mathbf{11}_2$ can be obtained by cutting, or otherwise dividing in any known manner, the first single mother substrate $\mathbf{201}_1$ into halves, while the two second glass substrates $\mathbf{21}_1$ and $\mathbf{21}_2$ can obtained by cutting one side edge of the second single mother substrate $\mathbf{201}_2$ to leave the scrap 96 and then cutting, or otherwise dividing in any known manner, the second mother substrate $\mathbf{201}_2$ into halves.

Figure 6A:
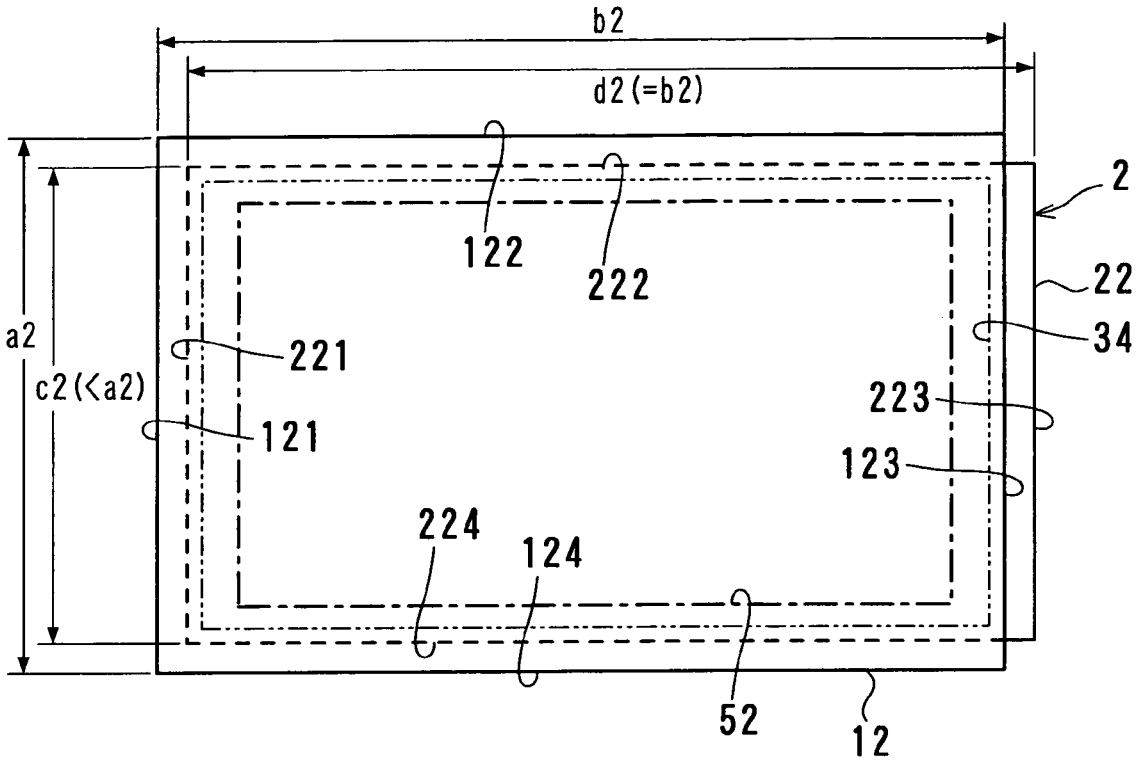
FIGS. 6A and 6B are views similar to FIGS. 4A and 4D, showing a second preferred embodiment of the plasma display panel according to the present invention.
Figure 6B:
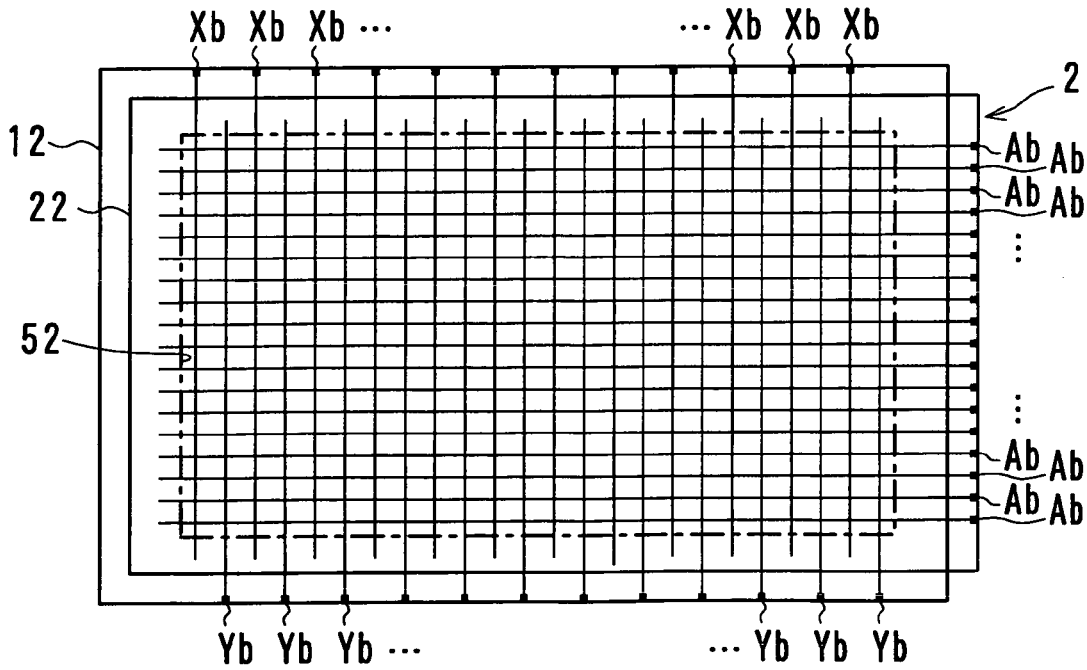

In a second preferred embodiment of the present invention shown in FIGS. 6A and 6B, the plasma display panel, now generally identified by 2, has a display screen area 52 formed by a sandwich structure of first and second glass substrates 12 and 22 of a generally or substantially rectangular configuration. The first and second glass substrates 12 and 22 are, as is well known to those skilled in the art, positioned generally one above the other and sealed together by means of a peripheral sealing member 34. With the glass substrates positioned one above the other in a fashion immovable relative to each other, one of those glass substrates 12 and 22 has at least a portion of the entire peripheral edge thereof protruding outwardly from that of the other of those glass substrates 12 and 22 as will become clear from the subsequent description.

The first glass substrate 12 has a peripheral edge made up of a pair of opposite short side edge portions 121 and 123 and a pair of opposite long side edge portions 122 and 124 and, similarly, the second glass substrate 22 has a peripheral edge made up of a pair of opposite short side edge portion 221 and 223 and a pair of opposite long side edge portions 222 and 224. Of the four side edge portions of the first glass substrate 12, two long edge portions that are opposite to each other, for example, the long side edge portions 122 and 124 have a length b2 which is substantially equal to the length d2 of each of two of the four side edge portions of the second glass substrate 22 that are opposite to each other, that is, the long side edge portions 222 and 224 of the second glass substrate 22. Also, the short side edge portions 121 and 123 of the first glass substrate 12 that are opposite to each other have a length a2 which is greater than the length c2 of each of the short side edge portions 221 and 223 of the second glass substrate 22.

Accordingly, when the first and second glass substrates 12 and 22 are positioned one above the other, the geometric center of the first glass substrate 12 is displaced relative to that of the second glass substrate 22 in a direction parallel to any one of the long side edges. In this displaced condition, since the opposite short side edge portions 121 and 123 of the first glass substrate 12 are longer than any one of the opposite short side edge portions 221 and 223 of the second glass substrate 22, it is clear that the long side edge portions 122 and 124 and one of the short side edge portions, that is, the short side edge portion 121 of the first glass substrate 12 protrude outwardly from the adjacent side edges 222, 224 and 221 of the second glass substrate 22 while the other short side edge portion 223 of the second glass substrate 22 protrude laterally outwardly from the remaining short side edge portion 123 of the first glass substrate 12 as best shown in FIG. 6A.

In the plasma display panel 2 according to the second embodiment, as best shown in FIG. 6B, the first and second display electrodes Xb and Yb deposited on an inner surface of the first glass substrate 12 facing the second glass substrate 22 are so arranged and so laid as to alternate one after the other, In this electrode arrangement, one of opposite ends, for example, a first end, of each of the first display electrodes Xb emerges outwardly from the display screen area 52 and, hence, the second glass substrate 22 and is positioned in the long side edge portion 122 thereof, whereas one of opposite ends of each of the second display electrodes Yb remote from the first ends of the first display electrode Xb, that is, a second end of each second display electrode Yb, emerges similarly outwardly from the display screen area 52 and, hence, the second glass substrate 22 and is positioned in the long side edge portion 124 of thereof.

On the other hand, the address electrodes Ab disposed on an inner surface of the second glass substrate 22 facing the first glass substrate 12 extend perpendicular to and across the first and second display electrodes Xb and Yb, each having one of its opposite ends emerging outwardly from the display screen area 52 and positioned only on the short side edge portion 223 of the second glass substrate 22.

It is to be noted that although in the second embodiment the first and second display electrodes Xb and Yb and the address electrodes Ab are oriented in respective directions different from those of the first and second display electrodes X and B and the address electrodes A according to the previously described first embodiment, the first and second display electrodes Xb and Yb and the address electrodes Ab correspond in function to the first and second display electrodes X and B and the address electrodes A, respectively.

In the manufacture of the flat panel displays, particularly that of the plasma display panel 2, the use of the glass substrates having their respective long side edges portions of an equal size is also effective to maximize the utilization of materials for those glass substrates. Specifically, when one of the first and second glass substrates which is larger than the other of the first and second glass substrate, that is, the first glass substrate 12 in this embodiment, is to be cut from a mother substrate of a size equal to the first glass substrate 12, no scrap will yield.

Also, since as described above, in this embodiment, the long side edge portions 122 and 124 and the short side edge portion 121 of the first glass substrate 12 protrude outwardly from the adjacent side edges 222, 224 and 221 of the second glass substrate 22 while the other short side edge portion 223 of the second glass substrate 22 protrude laterally outwardly from the remaining short side edge portion 123 of the first glass substrate 12. Accordingly, in terms of grinding efficiency, the entire peripheral edge of both of the first and second glass substrates 12 and 22 need not be ground and grinding to be effected to the peripheral edge of the sandwich structure of the first and second substrates 12 and 22 may be comparable to grinding of the peripheral edge of a single substrate, thus resulting in increase of the grinding workability.

In addition, since only one end of the electrodes, i.e., the first and second display electrodes Xb and Yb, protrudes laterally outwardly from the sealing member 34, the work load which would otherwise be imposed in applying electrically insulating and water proofing resins to the exposed portions of the electrodes can advantageously be reduced.

Figure 7A:
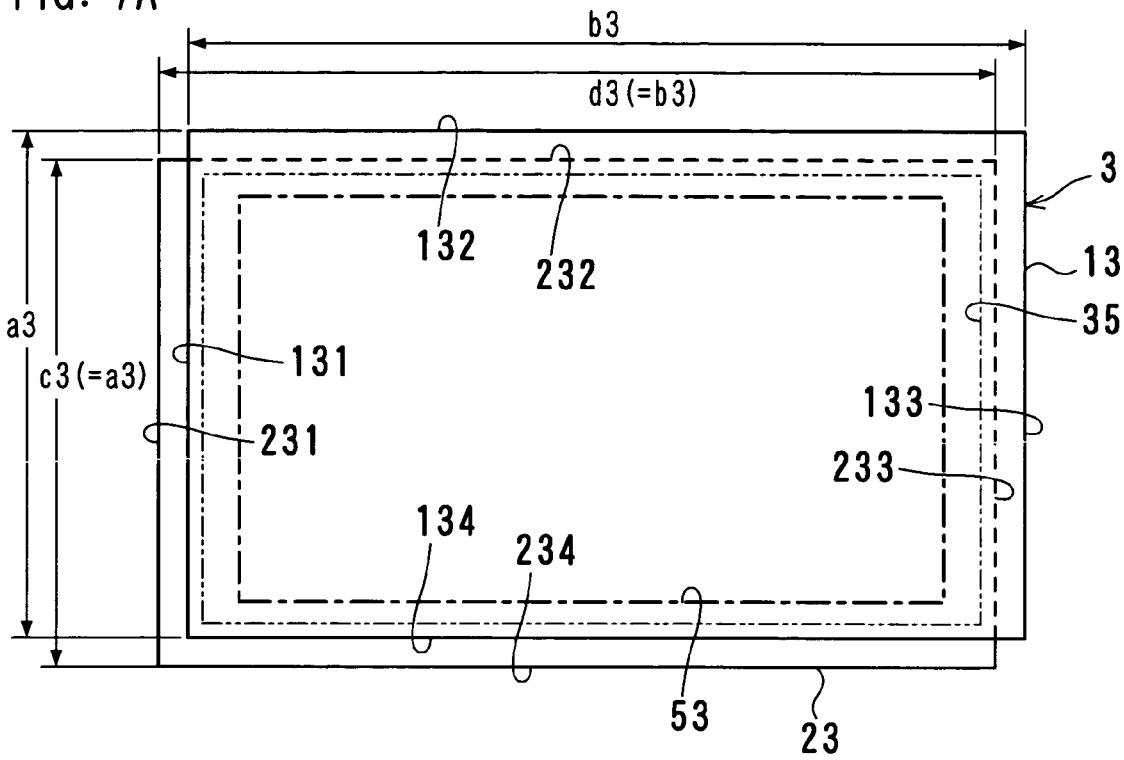
FIGS. 7A and 7B are views similar to FIGS. 4A and 4D, showing a third preferred embodiment of the plasma display panel according to the present invention.
Figure 7B:
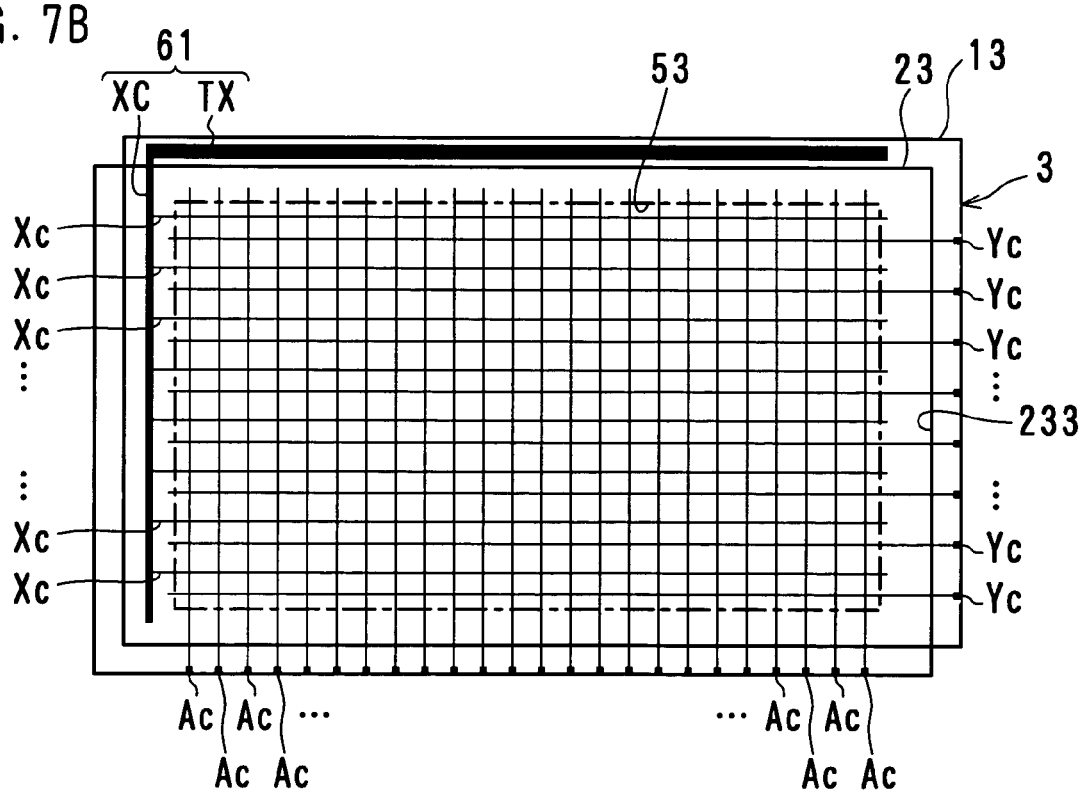

FIGS. 7A and 7B illustrate the plasma display panel 3 according to a third preferred embodiment of the present invention. Referring first to FIG. 7A, the plasma display panel 3 shown therein has a display screen area 53 formed by a sandwich structure of first and second glass substrates 13 and 23 of a generally or substantially rectangular configuration. The first and second glass substrates 13 and 23 are positioned generally one above the other and sealed together by means of a peripheral sealing member 35 while a portion of one of the first and second glass substrates 13 and 23 protrudes outwardly from the peripheral edge of the other of the first and second glass substrates 13 and 23.

Even in this embodiment, the first glass substrate 13 has a peripheral edge made up of a pair of opposite short side edge portions 131 and 133 and a pair of opposite long side edge portions 132 and 134 and, similarly, the second glass substrate 23 has a peripheral edge made up of a pair of opposite short side edge portions 231 and 233 and a pair of opposite long side edge portions 232 and 234. However, the first and second glass substrates 13 and 23 are of the same size and are, during the manufacture of the plasma display panel 3, positioned one above the other, having been displaced in a diagonal direction so that one of those glass substrates 13 and 23 may have at least a portion of the entire peripheral edge thereof protruding outwardly from that of the other of those glass substrates 13 and 23 as will become clear from the subsequent description.

More specifically, the first glass substrate 13 has a peripheral edge made up of a pair of opposite short side edge portions 131 and 133 and a pair of opposite long side edge portions 132 and 134 and, similarly, the second glass substrate 23 has a peripheral edge made up of a pair of opposite short side edge portion 231 and 233 and a pair of opposite long side edge portions 232 and 234. The short side edge portions 131 and 133 of the first glass substrate 13 have a length a3 which is substantially equal to the length c3 of each of the short side edge portions 231 and 233 of the second glass substrate 23, and the long side edge portions 132 and 134 of the first glass substrate 13 have a length b3 which is substantially equal to the length d3 of each of the long side edge portion 232 and 234 of the second glass substrate 23. Thus, the first and second glass substrates 13 and 23 are of the same size.

The first and second glass substrates 13 and 23 are positioned one above the other with the geometric center of the first glass substrate 13 displaced relative to that of the second glass substrate 23 in a diagonal direction so that two of the adjoining side edge portions, for example, the side edge portions 132 and 133, of the first glass substrate 13 can protrude outwardly from the adjacent side edge portions 232 and 233 of the second glass substrate 23 while the adjoining side edge portions 231 and 234 of the second glass substrate 23 protrude outwardly from the adjacent side edge portions 131 and 134 of the first glass substrate 13, i.e., from the peripheral edge of the first glass substrate 13 over the entire perimeter thereof.

In the plasma display panel 3 according to the third embodiment, as best shown in FIG. 7B, the first and second display electrodes Xc and Yc, which are deposited on an inner surface of the first glass substrate 13 facing the second glass substrate 23 and which form the surface discharge electrode pairs for inducing the discharge along the substrate surface, are so arranged and so laid as to alternate one after the other. In this electrode arrangement, the first ends of the second display electrodes Yc emerges outwardly from the display screen area 53 and are electrically connected with each other by means of a connecting conductor 61 at a location inwardly of the short side edge portion 131 of the first glass substrate 23, but outwardly of the display screen area 53, whereas the second ends of the second display electrodes Yc remote from the first ends of the first display electrode Xc emerges outwardly from the display screen area 53 and, hence, the second glass substrate 23 and are positioned in the short side edge portion 133 of the first glass substrate 13.

The connecting conductor 61 referred to above is patterned so represent an L-shaped configuration made up of a vertical conductor segment XC extending parallel to the short side edge portions of the first glass substrate 13 and a horizontal conductor segment TX extending parallel to the long side edge portions of the first glass substrate 13. The vertical conductor segment XC connects the first ends of the first display electrodes Xc together as hereinabove described, whereas the horizontal conductor segment XT is so deposited on the long side edge portion 132 of the first glass substrate 13 as to be exposed outwardly from the adjacent long side edge portion 232 of the second glass substrate 23 and is utilized as a terminal for electrically connecting the first ends of the first display electrodes Xc therethrough with an external drive circuit by way of the vertical conductor segment XC.

On the other hand, the address electrodes Ac disposed on an inner surface of the second glass substrate 23 facing the first glass substrate 13 extend perpendicular to and across the first and second display electrodes Xc and Yc, each having one of its opposite ends emerging outwardly from the display screen area 53 and positioned only on the long side edge portion 234 of the second glass substrate 23.

It is to be noted that the first and second display electrodes Xc and Yc and the address electrodes Ac, both employed in the third embodiment, correspond in function to the first and second display electrodes X and B and the address electrodes A employed in the first embodiment, respectively.

In the manufacture of the plasma display panel 3, the use of the glass substrates having the same size is also effective to maximize the utilization of materials for those glass substrates. Specifically, according to the third embodiment, since the first and second glass substrates 13 and 23 are of the same size, the use of mother substrates of the same size as that of the first and second glass substrates 13 and 23 as respective materials for the first and second glass substrates 13 and 23 do in no way yield any scrap when the first and second glass substrates 13 and 23 are to be prepared from those mother substrates.

Also, since as described above, the first and second substrates 13 and 23 are displaced diagonally relative to each other with the two adjoining side edge portions of one of the first and second substrates 13 and 14 consequently protruding laterally outwardly from the perimeter of the other of the first and second substrates 13 and 14. Accordingly, in terms of grinding efficiency, the entire peripheral edge of both of the first and second glass substrates 13 and 23 need not be ground and grinding to be effected to the peripheral edge of the sandwich structure of the first and second substrates 13 and 23 may be comparable to grinding of the peripheral edge of a single substrate, thus resulting in increase of the grinding workability.

In addition, since only one end of the electrodes, i.e., the first and second display electrodes Xc and Yc, protrudes laterally outwardly from the sealing member 35, the work load which would otherwise be imposed in applying electrically insulating and water proofing resins to the exposed portions of the electrodes can advantageously be reduced as compared with the case in which the opposite ends of the electrodes protrude laterally outwardly from the sealing member.

From the foregoing full description of some preferred embodiments of the present invention, it is clear that the material for the substrates used to form the display screen can advantageously be saved and, therefore, the present invention makes it possible to manufacture the flat panel displays at a reduced cost. As a matter of course, the present invention can be equally applied to any type of flat panel display that requires one of the first and second glass substrates to protrude outwardly from the contour of the other of the first and second glass substrates.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A flat panel display, which comprises:

tetragonal first and second substrates, each having a tetragonal peripheral edge, said first and second substrates opposing each other with one of the first and second substrates protruding in part outwardly from the peripheral edge of the other of the first and second substrates;

wherein two sides of the tetragonal peripheral edge of the first substrate, which are opposite to each other, are of a length equal to that of each of two sides of the tetragonal peripheral edge of the second substrate, which are opposite to each other; and wherein three sides of the peripheral edge of the first substrate, including said two opposite sides of the peripheral edge of the first substrate extend beyond the peripheral edge of the second substrate, and a distance that one peripheral edge of the first substrate extends beyond one peripheral edge of said second substrate is equal to a distance that an edge opposite said one peripheral edge of the second substrate extends beyond an edge opposite said one peripheral edge of said first substrate.

2. A plasma display panel, which comprises:

tetragonal first and second substrates, each having a tetragonal peripheral edge, said first and second substrates opposing each other with one of the first and second substrates protruding in part outwardly from the peripheral edge of the other of the first and second substrates;

wherein two short sides of the tetragonal peripheral edge of the first substrate, which are opposite to each other, are of a length substantially equal to that of each of two short sides of the tetragonal peripheral edge of the second substrate, which are opposite to each other; and wherein the two short sides of the peripheral edge of the first substrate and one of two long sides of the peripheral edge of the first substrate extend beyond the peripheral edge of the second substrate.

3. The plasma display panel as claimed in claim 2, further comprising a plurality of surface discharge electrode pairs for inducing an electric discharge along a substrate surface, each electrode pair including a first display electrode and a second display electrode, wherein the first and second display electrodes are arranged on the first substrate; wherein:

the first and second display electrodes extend across a display screen, and only one of opposite ends of each first display electrode and only one of opposite ends of each second display electrode are positioned outwardly from the peripheral edge of the second substrate.

4. The plasma display panel as claimed in claim 3, wherein the first display electrodes emerge outwardly from one of two opposite sides of the peripheral edge of the second substrate and the second display electrodes emerge outwardly from the other of the two opposite sides of the peripheral edge of the second substrate.

5. A plasma display panel, which comprises:

tetragonal first and second substrates, each having a tetragonal peripheral edge, said first and second substrates opposing each other with one of the first and second substrates protruding in part outwardly from the peripheral edge of the other of the first and second substrates; wherein:

two long sides of the tetragonal peripheral edge of the first substrate, which are opposite to each other, are of a length equal to that of each of two long sides of the tetragonal peripheral edge of the second substrate, which are opposite to each other; and the two long sides of the peripheral edge of the first substrate and one of two short sides of the peripheral edge of the first substrate extend beyond the peripheral edge of the second substrate, and a distance that one short side peripheral edge of the first substrate extends beyond one short side peripheral edge of said second substrate is equal to a distance that an edge opposite said short side peripheral edge of the second substrate extends beyond an edge opposite said short side peripheral edge of said first substrate.

6. The plasma display panel as claimed in claim 5, further comprising a plurality of surface discharge electrode pairs for inducing an electric discharge along a substrate surface, each electrode pair including a first display electrode and a second display electrode, wherein:

the first and second display electrodes are arranged on the first substrate;

the first and second display electrodes extend across the display screen; and only one of opposite ends of each first display electrode and only one of opposite ends of each second display electrode are positioned outwardly from the peripheral edge of the second substrate.

7. The plasma display panel as claimed in claim 6, wherein the first display electrodes emerge outwardly from one of two opposite sides of the peripheral edge of the second substrate and the second display electrodes emerge outwardly from the other of the two opposite sides of the peripheral edge of the second substrate.

8. A plasma display panel comprising:

A display screen including tetragonal first and second substrates, each having a tetragonal peripheral edge, said first and second substrates opposing each other with one of the first and second substrates protruding in part outwardly from the peripheral edge of the other of the first and second substrates; wherein:

two short sides of the tetragonal peripheral edge of the first substrate, which are opposite to each other, are of a length equal to that of each of two short sides of the tetragonal peripheral edge of the second substrate, which are opposite to each other, two long sides of the peripheral edge of the first substrate, which are opposite to each other, are of a length longer than that of each of two long sides of the tetragonal peripheral edge of the second substrate, which are opposite to each other, at least one of the two long sides of the peripheral edge of the first substrate is formed by cutting a mother substrate, at least one of the two long sides of the peripheral edge of the second substrate and at least one of the two short sides of the peripheral edge of the second substrate are formed by cutting another mother substrate, the two short sides of the peripheral edge of the first substrate and one of the two long sides of the peripheral edge of the first substrate positioned outwardly from the peripheral edge of the second substrate, and one of the two long sides of the peripheral edge of the second substrate positioned outwardly from the peripheral edge of the first substrate.

9. The plasma display panel according to claim 8, further comprising a plurality of surface discharge electrode pairs, each electrode pair including a first display electrode and a second display electrode; wherein:

the first and second display electrodes are arranged on an inner surface of the first substrate so as to extend in a direction along the long sides of the peripheral edge of the first substrate, one ends of the first display electrodes are arranged along one of the two short sides of the first substrate projecting over the peripheral edge of the second substrate, and one ends of the second display electrodes are arranged along another one of the two short sides of the first substrate projecting over the peripheral edge of the second substrate.

10. The plasma display panel according to claim 9, further comprising a plurality of address electrodes, each address electrodes being arranged on an inner surface of the second substrate so as to extend in a direction along the short sides of the peripheral edge of the second substrate; wherein:

one ends of the address electrodes are arranged along one of the two long sides of the second substrate projecting over the peripheral edge of the first substrate.

* * * * *